US009119482B2

(12) United States Patent
Cornmesser

(10) Patent No.: US 9,119,482 B2
(45) Date of Patent: Sep. 1, 2015

(54) AUTOMATIC BABY CARRIER ROCKING DEVICE

(71) Applicant: Steve M. Cornmesser, Fallon, NV (US)

(72) Inventor: Steve M. Cornmesser, Fallon, NV (US)

( * ) Notice: Subject to any disclaimer, the term of this patent is extended or adjusted under 35 U.S.C. 154(b) by 0 days.

(21) Appl. No.: 14/327,135

(22) Filed: Jul. 9, 2014

(65) Prior Publication Data

US 2015/0033883 A1 Feb. 5, 2015

Related U.S. Application Data

(60) Provisional application No. 61/861,835, filed on Aug. 2, 2013.

(51) Int. Cl.
*A47C 3/02* (2006.01)
*A47D 9/04* (2006.01)

(52) U.S. Cl.
CPC ..... *A47D 9/04* (2013.01)

(58) Field of Classification Search
CPC ..... A47D 13/10; A47D 3/027; A47D 3/02
USPC ..... 297/118, 133, 258.1, 260.2
See application file for complete search history.

(56) References Cited

U.S. PATENT DOCUMENTS

| | | | | | |
|---|---|---|---|---|---|
| 659,866 | A | * | 10/1900 | Cytron | 185/39 |
| 3,225,365 | A | * | 12/1965 | Miller et al. | 5/109 |
| 3,371,358 | A | * | 3/1968 | Shackel | 5/108 |
| 3,653,080 | A | * | 4/1972 | Hafele | 5/108 |
| 3,851,343 | A | * | 12/1974 | Kinslow, Jr. | 5/109 |
| 4,141,095 | A | * | 2/1979 | Adachi | 5/108 |
| 4,793,010 | A | * | 12/1988 | Gross et al. | 5/109 |
| 4,985,949 | A | * | 1/1991 | Jantz | 5/109 |
| 4,987,624 | A | * | 1/1991 | Nafti | 5/109 |
| 5,342,113 | A | * | 8/1994 | Wu | 297/260.2 |
| 5,368,361 | A | * | 11/1994 | Wen-Ming | 297/260.2 |
| 5,588,164 | A | | 12/1996 | Proulx | |
| 5,615,428 | A | * | 4/1997 | Li | 5/109 |
| 5,624,156 | A | * | 4/1997 | Leal et al. | 297/217.4 |
| 5,860,698 | A | * | 1/1999 | Asenstorfer et al. | 297/260.2 |
| 6,152,529 | A | * | 11/2000 | Beason | 297/260.2 |
| 6,250,654 | B1 | | 6/2001 | Willis | |
| 6,412,867 | B2 | * | 7/2002 | Robinson | 297/260.2 |
| 6,574,806 | B1 | * | 6/2003 | Maher | 5/109 |
| 7,485,086 | B2 | | 2/2009 | Dickie | |
| 7,537,285 | B2 | * | 5/2009 | Stewart | 297/260.1 |
| 7,633,401 | B1 | * | 12/2009 | Copley et al. | 340/664 |
| 7,874,617 | B2 | * | 1/2011 | Ogle | 297/260.2 |
| 7,891,736 | B2 | | 2/2011 | Sims | |
| 8,820,834 | B2 | * | 9/2014 | Harding et al. | 297/260.2 |
| 2010/0052387 | A1 | * | 3/2010 | Hopke et al. | 297/260.2 |

(Continued)

*Primary Examiner* — Laurie Cranmer
(74) *Attorney, Agent, or Firm* — Daniel Boudwin; Global Intellectual Property Agency, LLC

(57) ABSTRACT

The present invention describes a baby carrier rocking device. In one embodiment, the device includes a housing with an imbedded motor, MP3 player, and related components. The housing may feature various shapes and designs, and comprises an aperture at the top portion thereof. The aperture is adapted to hold a first end of an elongated arm therein. The second end of the elongated arm is adapted to rock a baby carrier. In operation, the motor actuates the elongated arm so that it extends upward at a regular interval, contacting a baby carrier and thereby pushing the same in a rocking motion. Each time the elongated arm is extended upward, it falls back down via gravity. In this way, the present invention provides parents or caregivers with a hands-free way to rock a baby carrier.

14 Claims, 5 Drawing Sheets

(56) References Cited

U.S. PATENT DOCUMENTS

2010/0218312 A1* 9/2010 Quintas Mendes ..... 5/109
2011/0260507 A1 10/2011 Parness
2012/0036635 A1 2/2012 Lapointe
2013/0026805 A1* 1/2013 Sclare et al. ..... 297/260.2
2014/0265490 A1* 9/2014 Hopke et al. ..... 297/260.2

* cited by examiner

AUTOMATIC BABY CARRIER ROCKING DEVICE

CROSS REFERENCE TO RELATED APPLICATION

This application claims the benefit of U.S. Provisional Application No. 61/861,835 filed on Aug. 2, 2013. The above identified patent application is herein incorporated by reference in its entirety to provide continuity of disclosure.

BACKGROUND OF THE INVENTION

Field of the Invention

The present invention relates to a baby carrier rocking device. More specifically, the present invention pertains to an automatic baby carrier rocking device that comprises a housing with an imbedded motor, which is used to actuate an elongated arm that rocks a baby carrier in a rhythmic motion. The present invention features a compact, portable design that is suitable for use with a wide variety of baby carriers.

When a baby is a newborn, many parents and caregivers cradle the baby in their arms and rock them in a back and forth motion, creating a bond between the baby and the parents or caregivers. Additionally, activities such as rocking can help stimulate a baby's vestibular system, which improves a baby's sense of balance. Rocking a baby in a rhythmic back and forth motion also helps to soothe and comfort the baby, because the rocking motion simulates the life in the mother's womb before the baby is born. As such, many parents and caregivers regularly simulate such rocking motion to induce the baby to sleep.

In order to facilitate rocking a baby, devices such as rocking chairs or gliders are used. A rocking chair includes a chair with two curved bands attached to the bottom of the legs, connecting the legs on each side to each other. The rockers contact the floor at two points, giving the user the ability to rock back and forth by shifting his or her weight or pushing lightly with his or her feet. Conversely, gliders slide back and forth on a fixed track instead of rocking. Alternatively, a baby may be placed in a car seat or a baby carrier while the base is gently rocked back and forth.

Traditional methods of rocking a baby, however, are inconvenient for many parents and caregivers. Rocking a baby in a back and forth motion requires the parents and caregivers to manually operate a device and constantly attend to the baby. Additionally, existing devices for swinging or rocking a baby in a back and forth motion have limited use and are often bulky and costly. Thus, a convenient, portable, and versatile device is needed that provides a rocking motion to a baby carrier.

The present invention provides an automatic baby carrier rocking device that is designed for use with various types of baby carriers. The present invention comprises a housing with an imbedded motor that is connected to an arm so that the arm moves in a linear reciprocating motion. The present invention is adapted to rock a baby carrier so as to slightly tip the carrier backwards at a regular interval and allowing it to come back to its starting position each time, thereby providing a rhythmic rocking motion. In some embodiments, the present invention may further comprise an MP3 player to play a pre-recorded sound or music. Use of the present invention allows for parents and caregivers to rock a baby carrier without manually simulating a rocking motion. In this way, the present invention provides convenience to the user while improving versatility of its use.

DESCRIPTION OF THE PRIOR ART

Devices have been disclosed in the prior art that relate to baby carrier rockers, and further to those emphasizing a hands-free method for rocking various baby carriers. These include devices that have been patented and published in patent application publications. Some of these patents describe a housing member with an imbedded motor, wherein a top portion of the housing member is adapted to support a baby carrier thereon. Other patents describe a baby carrier support with a curved lower surface that allows the baby carrier support to rock. These devices, however, do not disclose a compact and portable automatic baby carrier rocking device that may be used with a wide variety of baby carriers without mounting the carrier on the device. The following is a list of devices deemed most relevant to the present disclosure, which are herein described for the purposes of highlighting and differentiating the unique aspects of the present invention, and further highlighting the drawbacks existing in the prior art.

For example, U.S. Published Patent Application Number 2012/0036635 to Lapointe discloses a portable baby rocking system that comprises a housing with an imbedded motor and a frame attached to the housing. The frame is adapted to support a baby carrier thereon, wherein the baby carrier may be secured onto the frame via a strap system. While the device of Lapointe provides portable means to rock various baby carriers, it requires a user to secure the baby carrier onto the device in order to provide a rocking motion. In contrast, the present invention does not need to be attached to a baby carrier in order to provide a rocking motion thereto. The present invention comprises an elongated arm that is actuated by the motor to push the baby carrier as it extends in an upward direction. Accordingly, the present invention is operable when simply placed near the baby carrier.

Similarly, U.S. Pat. No. 7,891,736 to Sims discloses a mechanized baby carrier rocker comprising a base member and a motor that is attached to a tray member. The motor is attached to the tray member via one or more springs. The motor and the tray member are positioned on the base member via a shaft. In operation, a baby carrier is positioned in the tray and the motor is engaged to produce and maintain a rocking motion in the baby carrier. While the Sims device is adapted to provide a rocking motion in the baby carrier, the Sims device is limited in that the entire baby carrier must rest on the tray in order for the device to operate. Accordingly, the Sims device may not be accommodate baby carriers of various sizes and shapes. In contrast, the present invention comprises an automatic baby carrier rocking device that can be used with any variety of baby carriers. The present invention does not need to be permanently affixed to an existing baby carrier in order to operate, thereby increasing the versatility of a single baby carrier rocking device with regard to its usage.

Another device, U.S. Published Patent Application Number 2011/0260507 to Parness discloses a convertible infant rocker comprising a frame and a support assembly connected thereto. The support assembly includes a cradle, defining a cavity therein. The cavity may be adapted to receive a liner therein, wherein the liner is engaged to the cradle. Optionally, the liner may be replaced with a conventional car seat for use in a vehicle. The frame is configured to impart a rocking or swaying motion to the seat in response to movement of the infant, or in response to a light push by a parent or caregiver. Accordingly, the device of Parness differs from the present invention in that it does not comprise a motor to provide an automatic rocking motion of a baby carrier. The motor of the present invention eliminates the need for the parent or caregiver to constantly rock the baby carrier, thereby providing a convenient and hands-free method to rock the baby carrier.

U.S. Pat. No. 7,485,086 to Dickie discloses an infant rocking assembly comprising a housing with a top, base, and an imbedded motor therebetween. The housing further includes a sound-producing device for playing music. The device is adapted to move in a manner which is synchronized with the music. The top of the housing is adapted to support a baby carrier thereon. In this way, the device is positioned under the baby carrier in its operative state. In contrast, the present invention comprises an elongated arm that is removably connected to a compact housing member having an imbedded motor therein. When in use, the present invention is placed at or near the foot of a baby carrier so that the baby carrier is not resting on the device. This enables the elongated arm to extend and retract, thereby pushing the baby carrier.

U.S. Pat. No. 5,588,164 to Proulx discloses an infant carrier seat support comprising a housing member having a recessed top surface and a curved bottom surface. The top surface is adapted to receive an infant carrier seat therein. The bottom surface is adapted to rock on a generally flat support surface. Accordingly, the Proulx device lacks means to automatically rock the infant carrier seat attached thereto. In contrast, the present invention comprises a motor for automatically rocking a baby carrier. In this way, the present invention provides parents or caregivers with a hands-free way to rock the baby carrier.

Finally, U.S. Pat. No. 6,250,654 to Willis discloses a combination car seat and stroller assembly with an integrated rocking mechanism. The Willis device comprises docking supports having a spring motor mounted thereon. The docking supports are adapted to hold a car seat via one or more mounting plates. Additionally, the car seat is securely held in place via a seat support pin. While Willis discloses a device that automatically rocks a baby carrier, the purpose and intent of the Willis device differ from the present invention in that the Willis device is intended for use with a stroller having a removable car seat. In contrast, the present invention is used with a wide variety of baby carriers resting on a horizontal surface, as it is not necessary to rock a baby carrier while the seat is mounted on a stroller. The movement of a stroller can help calm the babies and induce them to sleep, eliminating the need for a rocking device. Additionally, as the present invention is intended to provide a hands-free way to rock the baby carrier, it is not required when a parent or a caregiver is pushing the stroller.

These prior art devices have several known drawbacks. These devices are bulky and cannot be operated without securing a baby carrier onto the device. Additionally, the prior art devices are designed for use with limited types of baby carriers. It is therefore submitted that the present invention substantially diverges in design elements from the prior art, which overcomes the disadvantages of the prior art devices, and consequently it is clear that there is a need in the art for an improvement to existing baby carrier rockers. In this regard the instant invention substantially fulfills these needs.

SUMMARY OF THE INVENTION

In view of the foregoing disadvantages inherent in the known types of baby carrier rockers now present in the prior art, the present invention provides a new improvement to an automatic baby carrier rocking device wherein the same can be utilized for providing a continuous rocking motion of a baby carrier to help soothe a baby.

It is therefore an object of the present invention to provide a new and improved automatic baby carrier rocking device that has all of the advantages of the prior art and none of the disadvantages.

It is another object of the present invention to provide a new and improved automatic baby carrier rocking device having a compact housing member with an imbedded motor that is adapted to actuate a removably connected elongated arm to rock a baby carrier.

Another object of the present invention is to provide a new and improved automatic baby carrier rocking device having a speed control that allows a user to change the speed of the movement of the elongated arm to rock a baby carrier.

Yet another object of the present invention is to provide a new and improved automatic baby carrier rocking device that provides a hands-free method to rock a baby carrier.

Still yet another object of the present invention is to provide a new and improved automatic baby carrier rocking device that utilizes gravity and momentum to rock a baby carrier.

Still yet another object of the present invention is to provide a new and improved automatic baby carrier rocking device having a housing member that comprises complex shapes and decorative features.

Still yet another object of the present invention is to provide a new and improved automatic baby carrier rocking device that may be used with a wide variety of baby carriers.

Still yet another object of the present invention is to provide a new and improved automatic baby carrier rocking device having an MP3 player and a speaker to play a pre-recorded sound.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and in manner in which it may be made and used may be better understood after a review of the following description, taken in connection with the accompanying drawings wherein like numeral annotations are provided throughout.

DETAILED DESCRIPTION OF THE INVENTION

Figure 1:
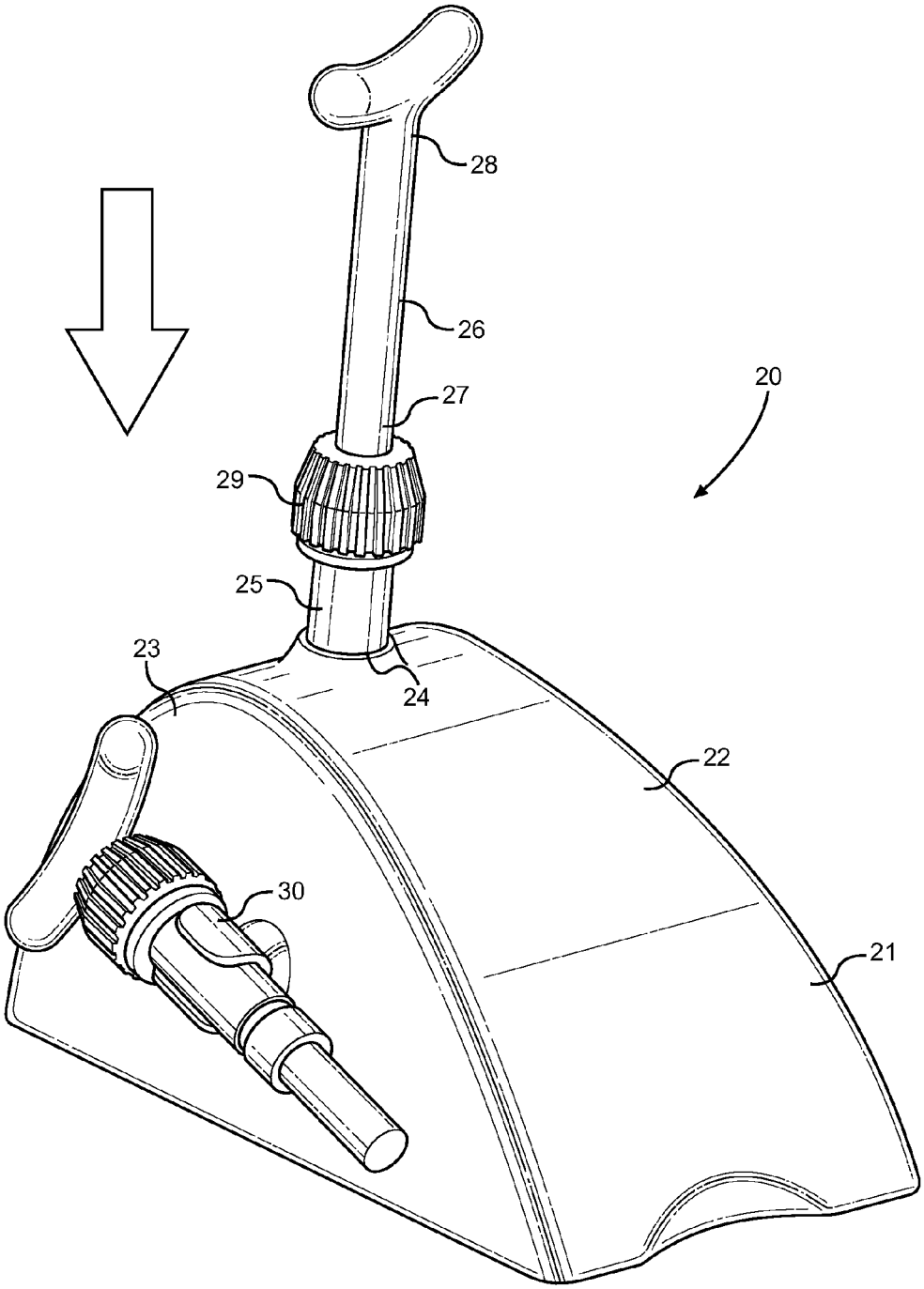
FIG. 1 shows a front perspective view of an embodiment of the present invention.

Reference is made herein to the attached drawings. Like reference numerals are used throughout the drawings to depict like or similar elements of the automatic baby carrier rocking device. For the purposes of presenting a brief and clear description of the present invention, the preferred embodiment will be discussed as utilized for providing a continuous rocking motion of a baby carrier to help soothe a baby. The figures are intended for representative purposes only and should not be considered to be limiting in any respect.

Figure 2:
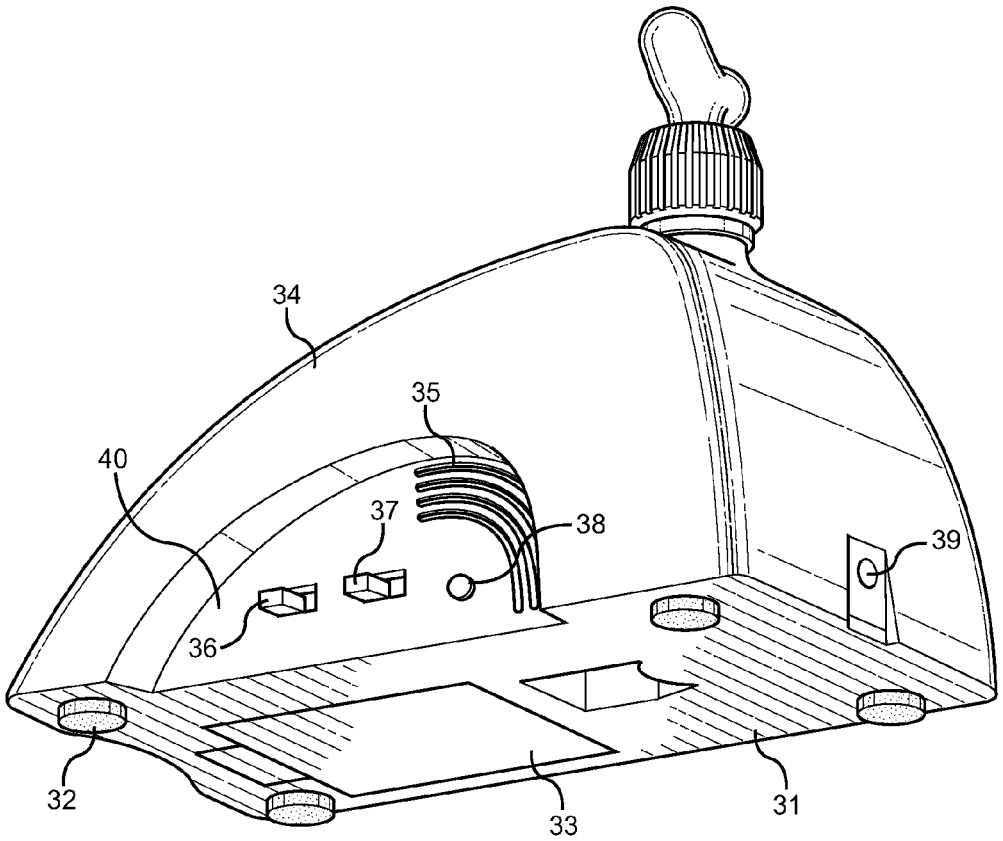
FIG. 2 shows a rear perspective view of an embodiment of the present invention.

Referring now to FIGS. 1 and 2, there is shown a front perspective view and a rear perspective view of the present invention, respectively. The automatic rocking device 20 as shown in the illustrated embodiment comprises a housing 21 having an arcuate top wall 22, a first side wall 23 opposite a second side wall 34, leaving the bottom portion of the housing 21 open and defining an interior volume. The housing 21 of the present invention comprises rigid material such as plastic, metal, or other suitable material. The interior volume of the housing 21 includes an MP3 player, a speaker, an internal power source, an imbedded motor, and necessary internal circuitry to execute the motor, the MP3 player, and the speaker. The interior volume of the housing 21 may further comprise a power switch and a speed control that controls operation of the motor and speed of the movement of the elongated arm 26, as well as a music switch that turns the MP3 player and the speaker on or off. The rocking device 20 of the present invention may be also externally powered via an AC/DC power adapter port 39 disposed in the back portion of the top wall 22 of the housing 21.

The top wall 22 of the housing 21 comprises an aperture 24 for receiving an extension arm 25 therethrough. The extension arm 25 is connected to an elongated arm 26 that is adapted to extend and retract. The elongated arm 26 has a circular cross section with a diameter that is substantially uniform throughout its length. The elongated arm 26 comprises a first end 27 and a second end 28, wherein the first end 27 is removably inserted through an annular joint 29 so that the elongated arm 26 is in a substantially vertical position. The second end 28 of the elongated arm 26 is substantially straight and perpendicular to the rest of the elongated arm 26, thereby forming a T-shape. In some embodiments, the second end 28 may be curved so that it forms a Y-shape. Additionally, the second end 28 of the elongated arm 26 may comprise a padded material or a coating for a smooth finish. In some embodiments, the first side wall 23 may comprise a clip 30 for an additional elongated arm, a joint, and an extension arm. The additional elongated arm, the joint, and the extension arm are substantially equal in shape and size to the elongated arm 26, the joint 29, and the extension arm 25 on the top wall 22 of the housing 21. The clip 30 may be press fitted to an aperture disposed on the first side wall 23. The clip 30 may comprise a U-shaped portion that is adapted to hold the additional elongated arm.

The housing 21 further comprises a base 31 attached thereto at the open bottom portion thereof. The base 31 spans the open bottom portion of the housing 21 and comprises a side wall 40 that extend upward therefrom. The side wall 40 is configured to fit in the cutout of the second side wall 34 of the housing 21. The side wall 40 comprises a power switch 36, a speed control switch 27, a music switch 38, and concentric cutouts 35 for the speaker. The base 31 also comprises a battery door 33 hingedly attached thereto, wherein the battery door 33 provides access to the batteries in the interior volume of the housing 21. The base 31 is attached to the housing 21 by means of fasteners, such as screws. Each of the fasteners are covered by a rubber foot 32 having a disc shape.

In other embodiments, the housing of the present invention may be substantially cube-shaped or may be in the shape of any type of animal or cartoon figures, toys, lettering, numbering, symbols, and the like. Without limitation, examples of animal shapes include turtles, butterflies, whales, and lady bugs. Accordingly, the arm may comprise different shapes and designs to match the design or theme of the housing. For instance, the housing may be in a shape of a whale and the elongated arm may be in a shape of a whale's spout. The specific shape and design of the housing, and the elongated arm, however, is not of primary relevance with regard to the intent of the present invention, which portends to provide an improved automatic baby carrier rocking device that can rock a variety of baby carriers in a back and forth motion.

Figure 3:
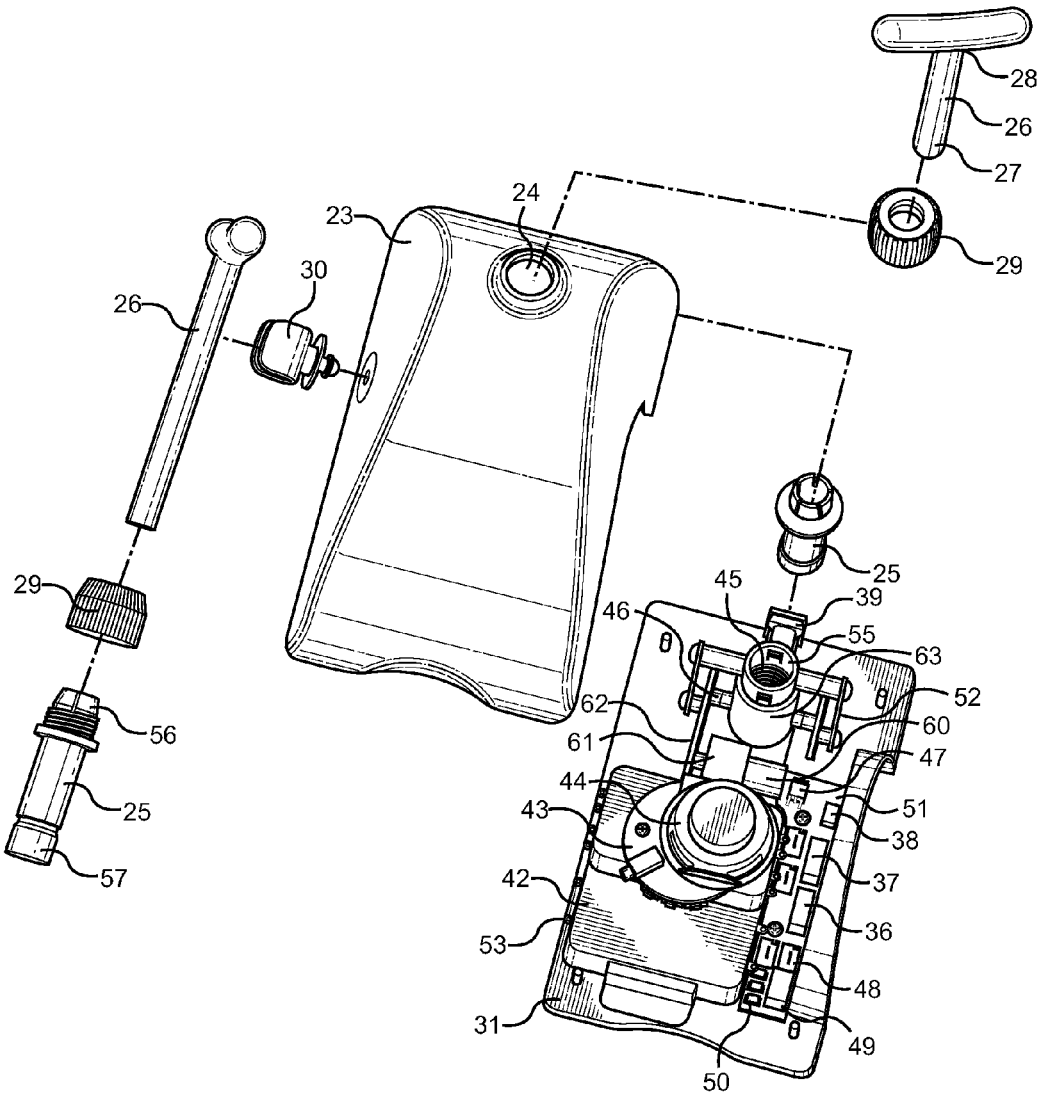
FIG. 3 shows a top exploded view of the present invention.

Referring now to FIG. 3, there is shown a top exploded view of the present invention. The housing is adapted to enclose the electrical components of the present invention and support the elongated arm 26 and its related components. The first end 27 of the elongated arm 26 is inserted through the joint 29, which rests above the housing. Thereafter, the first end 27 of the elongated arm 26 is inserted into the extension arm 25, which comprises an upper end 56 that rests above the housing and a lower end 57 that is adapted to be disposed in the interior volume of the housing. The extension arm 25 helps guide the elongated arm 26 move from a fully extended position to a retracted position. In the illustrated embodiment, each of the upper end 56 of the extension arm 25 and the interior surface of the joint 29 comprise threaded elements therearound. In this way, the joint 29 can be screwed onto the upper end 56 of the extension arm 25.

The lower end 57 of the extension arm 25 is inserted in a sleeve 55 having a spring 45 therein. In this way, the sleeve 55 is spring biased. The sleeve 55 comprises a cylindrical portion having an upper and a lower end. The lower end of the cylindrical portion is slideably disposed in the protruding portion 63 of the base 31. The upper end of the cylindrical portion comprises a pair of arms at opposing ends thereof. Each of the arms of the sleeve 55 is connected to a rear gear 46 via a piston arm 52. One or both of the rear gear 46 is connected to a front gear 62, and each of the rear 46 and front gear 62 is actuated by means of a motor 60 that is connected to a motor bracket 61.

In operation, the motor 60 rotates the gears 46, 62 so that the piston arm 52 and the sleeve 55 can move up and down at regular intervals. Because the sleeve 55 is spring biased, the movement of the sleeve 55 also moves the extension arm 25 and the elongated arm 26 in a gentle up and down motion. When the elongated arm 26 is in an upward motion, the elongated arm 26 is in a fully extended position. As the elongated arm 26 slides back down by gravity, the second end 28 of the elongated arm 26 rests on the joint 29 and the elongated arm 26 is in a retracted position. When the elongated arm 26 is in a retracted position, the process is repeated so that the elongated arm 26 is moved in an upward motion, into a fully extended position. The speed of the movement of the elongated arm 26 may be controlled via the speed control 37 that is disposed on the printed circuit board (PCB) 51.

The interior volume of the housing may further comprise an MP3 player 43 and a speaker 44 therein. The MP3 player 43 is capable of storing pre-recorded audio or music clip that may comprise a lullaby or the like. The speaker 44 is adapted to transmit the pre-recorded audio or music clip. The MP3 player 43 may be operated by a music switch 38, which is also disposed on the PCB 51. In this way, the MP3 player 43 and the speaker 44 may be separately operated from the motor 60.

The motor 60, MP3 player 43, and the speaker 44 may also be internally powered via batteries that are disposed in the battery compartment 42. The battery compartment 42 comprises a pair of battery holders 53 for each of the batteries therein. The batteries are connected to the PCB 51 having a transistor 47, a plurality of connectors 48, a DC converter 49, and a plurality of diodes 50, such as a semiconductor diode. The PCB 51 is connected to the base 31 by means of fasteners.

Figure 4:
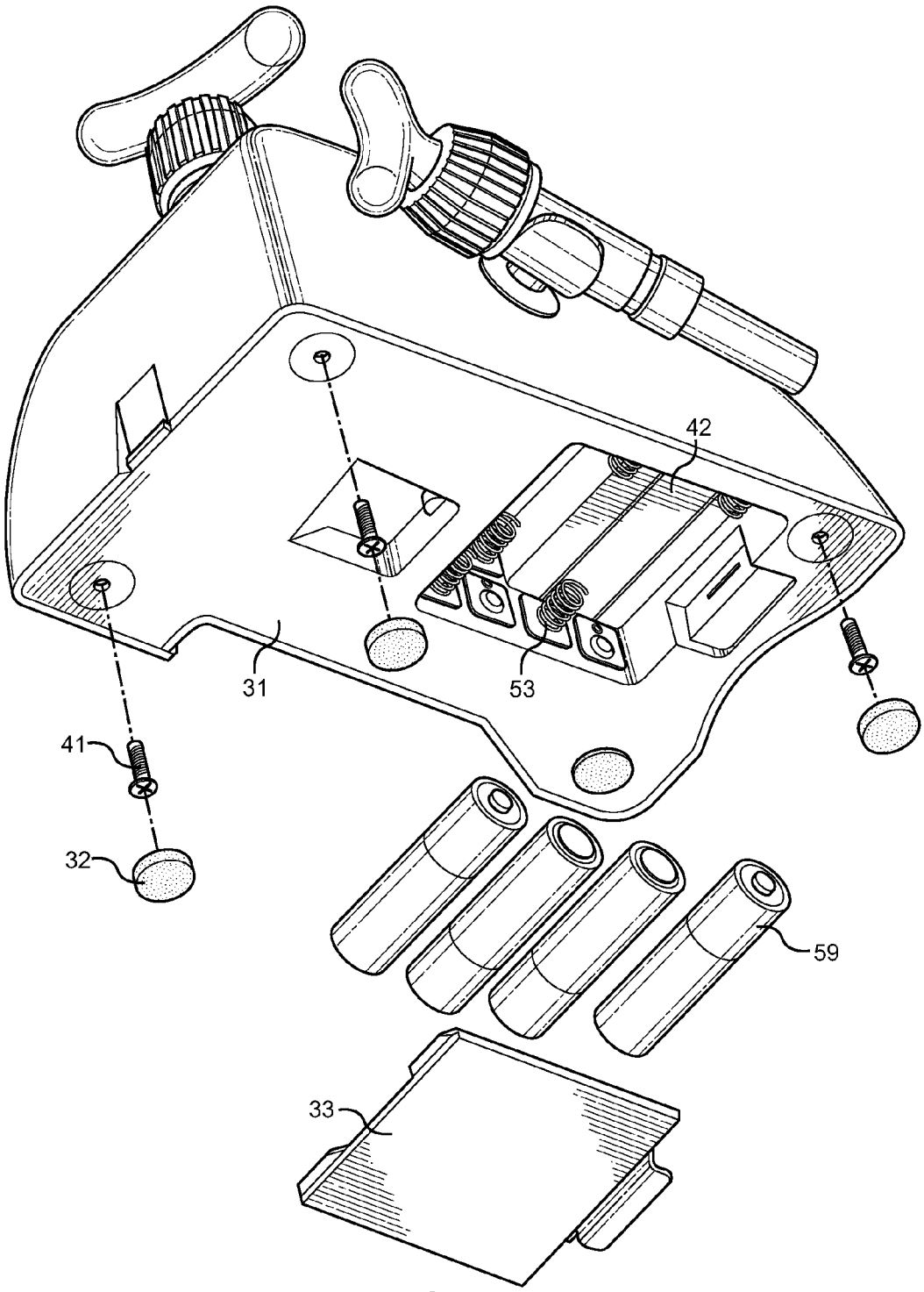
FIG. 4 shows a bottom exploded view of the present invention.

Referring now to FIG. 4, there is shown a bottom exploded view of the present invention. The base 31 comprises a battery compartment 42 that is accessible via the battery door 33 removably attached thereto. The battery door 33 creates a contiguous surface when attached to the base 31. The battery compartment 42 is constructed to fit a plurality of standard size batteries 59 therein. Each of the terminal ends of the batteries 59 is adapted to contact the battery holder 53 that is affixed to the battery compartment 42. The battery holder 53 comprises coiled spring wire that press against the terminal ends of the battery 59. Alternatively, the battery holder 53 may comprise flat tabs. In this way, the battery holder 53 makes electrical contact with the terminal ends of the battery 59.

The base 31 is attached to the housing by means of fasteners 41. The base 31 comprises a threaded aperture at each of the corners thereof, wherein each of the aperture is adapted to receive a fastener 41 therethrough. Once the fasteners 41 are secured in the base 31, the fasteners are covered 41 with rubber feet 32. The rubber feet 32 help prevent the rocking device from slipping or skidding when in use.

Figure 5:
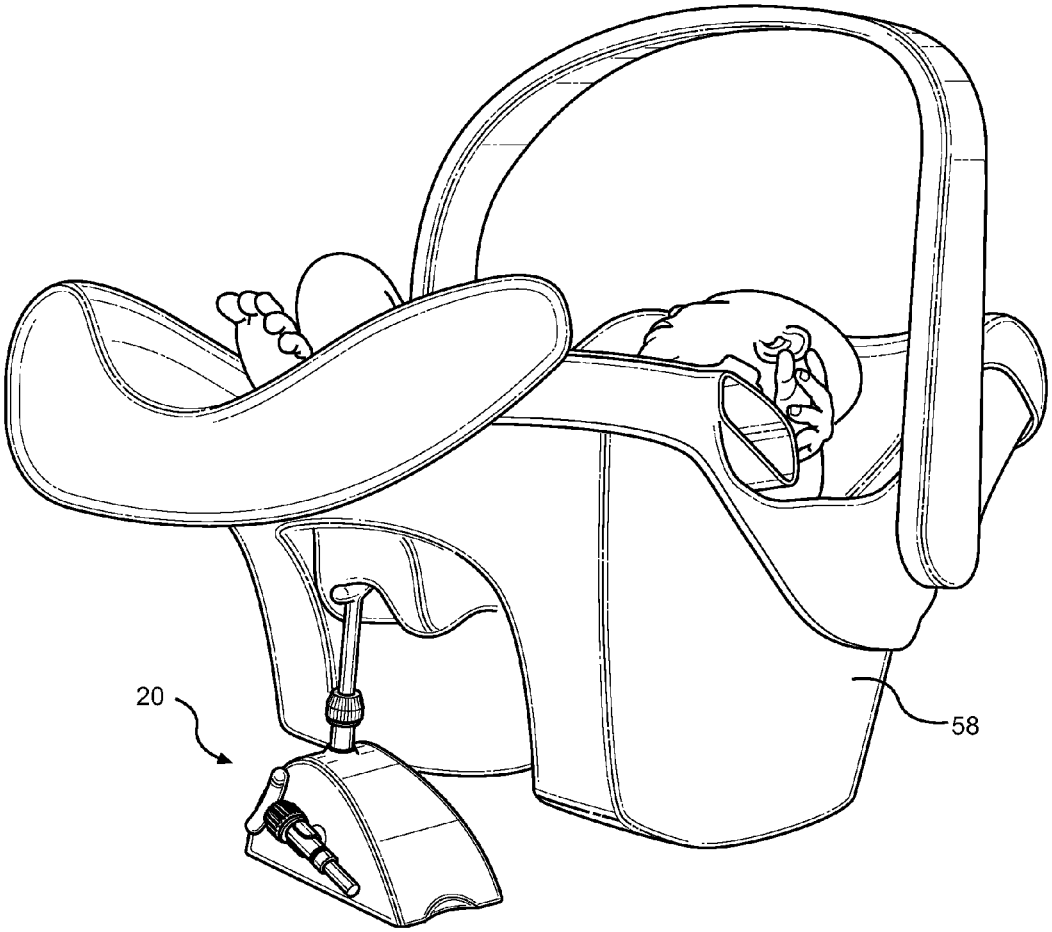
FIG. 5 shows a view of the present invention in use.

Referring now to FIG. 5, there is shown a view of the present invention in use. In operation, the present rocking device 20 is placed near the underside of the foot of a baby carrier 58 that is resting on a horizontal surface. The bottom wall of the present rocking device 20 comprises non-slip rubber feet so that the device is prevented from shifting during use. The motor is adapted to drive the elongated arm in an upward direction so that the second end of the arm contacts a portion of the baby carrier 58, thereby tipping it slightly backward. Thereafter, the gravity pulls the elongated arm back down to its starting position, as the baby carrier 58 also comes back to its starting position. When the elongated arm is retracted, the motor drives the elongated arm in an upward direction, repeating the process. The extension and retraction of the elongated arm repeats at regular intervals in order to facilitate a continuous rocking motion of the baby carrier 58.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An automatic baby carrier rocking device, comprising:

a housing having a top wall, a first side wall opposite a second side wall, and a base, forming an interior volume for enclosing a motor and a power source;

said top wall having an aperture;

an elongated arm having a first end and a second end;

said first end of said elongated arm operably connected to said motor and extending through said aperture such that said elongated arm is in a substantially vertical orientation;

said second end of said elongated arm adapted to engage an underside of a baby carrier;

wherein said elongated arm is actuated by said motor to move from a retracted position to an extended position at a regular interval;

wherein said first end of said elongated arm is removably inserted through an annular joint that is removably secured to an extension arm;

said annular joint disposed above said aperture of said housing;

said extension arm inserted in a sleeve disposed in said interior volume of said housing;

said sleeve having a pair of arms that are connected to gears by means of piston arms;

said gears being driven by said motor;

wherein said sleeve and said piston arms move in an upward direction and in a downward direction as said gears rotate;

wherein said sleeve and said piston arms are assisted by gravity when moving in said downward direction.

2. The baby carrier rocking device of claim 1, further comprising a speed control switch that controls the speed of the movement of said elongated arm.

3. The baby carrier rocking device of claim 1, further comprising a power switch.

4. The baby carrier rocking device of claim 1, further comprising an MP3 player and a speaker enclosed in said interior volume of said housing.

5. The baby carrier rocking device of claim 4, further comprising a music switch to operate said MP3 player and said speaker.

6. The baby carrier rocking device of claim 1, wherein:

said first side wall comprises an aperture having a clip secured thereto;

said clip comprises a U-shaped portion to hold said elongated arm.

7. The baby carrier rocking device of claim 1, wherein said power source comprises one or more batteries.

8. The baby carrier rocking device of claim 1, wherein said base further comprises:

a battery compartment having a plurality of battery holders;

a battery door removably attached to said base to enclose one or more batteries in said battery compartment.

9. The baby carrier rocking device of claim 1, wherein said sleeve is spring biased.

10. The baby carrier rocking device of claim 1, wherein said sleeve pushes said extension arm and said elongated arm in an upward direction.

11. The baby carrier rocking device of claim 1, further comprising a power adapter port disposed on said housing.

12. The baby carrier rocking device of claim 1, wherein said second end of said elongated arm comprises a T-shaped to engage an underside of a baby carrier.

13. The baby carrier rocking device of claim 1, wherein:

said base is configured to cover an open bottom portion of said housing;

said base is secured to said open bottom portion of said housing by means of fasteners.

14. The baby carrier rocking device of claim 13, wherein said base further comprises:

a plurality of rubber feet;

each of said plurality of rubber feet placed over each of said fasteners.

* * * * *